US008387219B2

(12) United States Patent
Rojdev

(10) Patent No.: US 8,387,219 B2
(45) Date of Patent: Mar. 5, 2013

(54) CASKET ORNAMENT ATTACHMENT MECHANISM

(75) Inventor: Ilija Rojdev, Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 86 days.

(21) Appl. No.: 13/089,734

(22) Filed: Apr. 19, 2011

(65) Prior Publication Data

US 2012/0266423 A1 Oct. 25, 2012

(51) Int. Cl.
*A61G 17/00* (2006.01)

(52) U.S. Cl. ..... 27/10; 27/1

(58) Field of Classification Search ..... 27/2, 10, 27/14, 19, 1; 40/124.5, 661.06, 600, 711, 40/124.04; 428/542.4, 900, 913.3; 52/288.1; 403/353, DIG. 1

See application file for complete search history.

(56) References Cited

U.S. PATENT DOCUMENTS

| | | | | |
|---|---|---|---|---|
| 2,659,169 | A * | 11/1953 | Brennan | 40/1.5 |
| 2,712,191 | A * | 7/1955 | Hillenbrand | 428/3 |
| 3,025,624 | A * | 3/1962 | Harrell | 40/124.5 |
| 3,115,434 | A * | 12/1963 | Hahn | 428/3 |
| RE25,525 | E * | 2/1964 | Harrell | 428/3 |
| 6,557,222 | B2 | 5/2003 | Groemminger et al. | |
| 6,591,466 | B1 | 7/2003 | Acton et al. | |
| 6,691,385 | B2 | 2/2004 | Bell et al. | |
| 6,715,190 | B2 | 4/2004 | Groemminger et al. | |
| 6,928,706 | B2 | 8/2005 | Acton et al. | |
| 7,159,287 | B2 | 1/2007 | Parker et al. | |
| 7,356,891 | B2 * | 4/2008 | Freeman | 27/35 |
| 7,584,529 | B1 | 9/2009 | Parker | |
| 7,591,052 | B2 | 9/2009 | Bovard et al. | |
| 7,657,981 | B2 | 2/2010 | Parker | |
| 8,196,275 | B2 * | 6/2012 | Wessel | 27/10 |
| 8,220,119 | B2 * | 7/2012 | Burlage et al. | 27/14 |
| 2006/0032097 | A1 * | 2/2006 | Cope | 40/600 |
| 2010/0077579 | A1 | 4/2010 | Parker | |
| 2010/0293826 | A1 * | 11/2010 | Mottola | 40/590 |
| 2010/0299895 | A1 | 12/2010 | Burlage et al. | |
| 2012/0192390 | A1 * | 8/2012 | Burlage et al. | 27/14 |

* cited by examiner

*Primary Examiner* — William L. Miller

(74) *Attorney, Agent, or Firm* — Wood, Herron & Evans, LLP; Wayne L. Jacobs

(57) ABSTRACT

A casket comprises a casket shell, a casket lid closeable on the shell, a mounting plate mounted to the shell, the plate including at least one keyhole groove therein, a medallion casket ornament having a rear side, the ornament including at least one magnet mounted on the rear side, and a magnetic adapter plate having a rear side, the adapter plate including at least one fastener with a head thereon mounted on the rear side, the adapter plate removably secured to the shell by inserting the head of the fastener in the keyhole groove in the mounting plate and seating the head of the fastener in the keyhole groove, the casket ornament removably secured to the shell by positioning the at least one magnet of the ornament on the adapter plate.

21 Claims, 5 Drawing Sheets

CASKET ORNAMENT ATTACHMENT MECHANISM

RELATED APPLICATIONS

N/A

FIELD

The subject matter herein relates generally to caskets, and more particularly to mechanisms for attaching ornaments to caskets, urns, and other funerary articles.

BACKGROUND

It is known to attach decorative ornaments to caskets to "personalize" the casket to the deceased. Examples of mechanisms for attaching ornaments to the exterior of a casket, for example to the corners of the casket shell, are shown in, for example, U.S. Pat. Nos. 6,591,466, 6,928,706, and 7,591,052, and U.S. Patent Application Publication 2010/0077579, all hereby incorporated by reference herein as if fully set forth in their entireties. Examples of mechanisms for attaching ornaments to the interior of a casket, for example to the cap panel mounted in the underneath side of the head end casket cap, are shown in, for example, U.S. Patent Application Publication 2010/0299895, hereby incorporated by reference herein as if fully set forth in its entirety.

One embodiment of the ornaments for attachment to the cap panel disclosed in U.S. Patent Application Publication 2010/0299895 utilizes one or more magnets mounted on the rear side of the "medallion" style ornament for magnetically attaching the medallion to a magnetic cap panel. On the other hand, the casket corner ornaments of U.S. Pat. Nos. 6,591,466 and 6,928,706, and U.S. Patent Application Publication 2010/0077579, utilize fasteners with heads, mounted on the rear side of the ornament, which are secured in L-shaped keyhole slots in the casket shell corners.

It is desirable to be able to utilize the medallion ornaments with magnets thereon with the casket shell L-shaped keyhole slots so that the medallions can also be mounted on the casket shell corners.

SUMMARY

Accordingly, a casket comprises a casket shell, a casket lid closeable on the shell, a mounting plate mounted to the shell, the mounting plate including at least one keyhole groove therein, a medallion casket ornament having a rear side, the ornament including at least one magnet mounted on the rear side, and a magnetic adapter plate having a rear side, the adapter plate including at least one fastener with a head thereon mounted on the rear side, the adapter plate removably secured to the shell by inserting the head of the fastener in the keyhole groove in the mounting plate and seating the head of the fastener in the keyhole groove, the casket ornament removably secured to the shell by positioning the at least one magnet of the ornament on the adapter plate.

The mounting plate can include two vertically spaced keyhole grooves therein, each being L-shaped, and the adapter plate can include two vertically spaced fasteners. The surface area of the adapter plate can be larger than a surface area of the mounting plate. The adapter plate and medallion casket ornament can be generally circular. The adapter plate and medallion casket ornament can be generally disk-shaped.

The adapter plate can include a feature around at least a portion of a periphery thereof that facilitates grasping the periphery of the adapter plate. For example, the adapter plate can be circular and include edge portions at 3 o'clock and at 9 o'clock bent forwardly out of a plane defined by a front surface of the adapter plate. Or, the adapter plate can be circular and include edge scallops at 3 o'clock and at 9 o'clock. Or, the adapter plate can be circular and include a forwardly projecting flange around a circumference thereof.

In another aspect, a funerary receptacle for containing remains of a deceased comprises a container adapted to contain the remains, a lid closeable on the container, a mounting plate mounted to the container, the mounting plate including at least one keyhole groove therein, a medallion funerary receptacle ornament having a rear side, the ornament including at least one magnet mounted on the rear side, and a magnetic adapter plate having a rear side, the adapter plate including at least one fastener with a head thereon mounted on the rear side, the adapter plate removably secured to the container by inserting the head of the fastener in the keyhole groove in the mounting plate and seating the head of the fastener in the keyhole groove, the ornament removably secured to the container by positioning the at least one magnet of the ornament on the adapter plate.

The container can be either a casket shell or a cremation urn.

In another aspect, a funerary article comprises a mounting surface, the mounting surface including at least one keyhole groove therein, a medallion funerary ornament having a rear side, the ornament including at least one magnet mounted on the rear side, and a magnetic adapter plate having a rear side, the adapter plate including at least one fastener with a head thereon mounted on the rear side, the adapter plate removably secured to the mounting surface by inserting the head of the fastener in the keyhole groove in the mounting surface and seating the head of the fastener in the keyhole groove, the ornament removably secured to the adapter plate by positioning the at least one magnet of the ornament on the adapter plate.

DRAWINGS

DESCRIPTION

Figure 1:
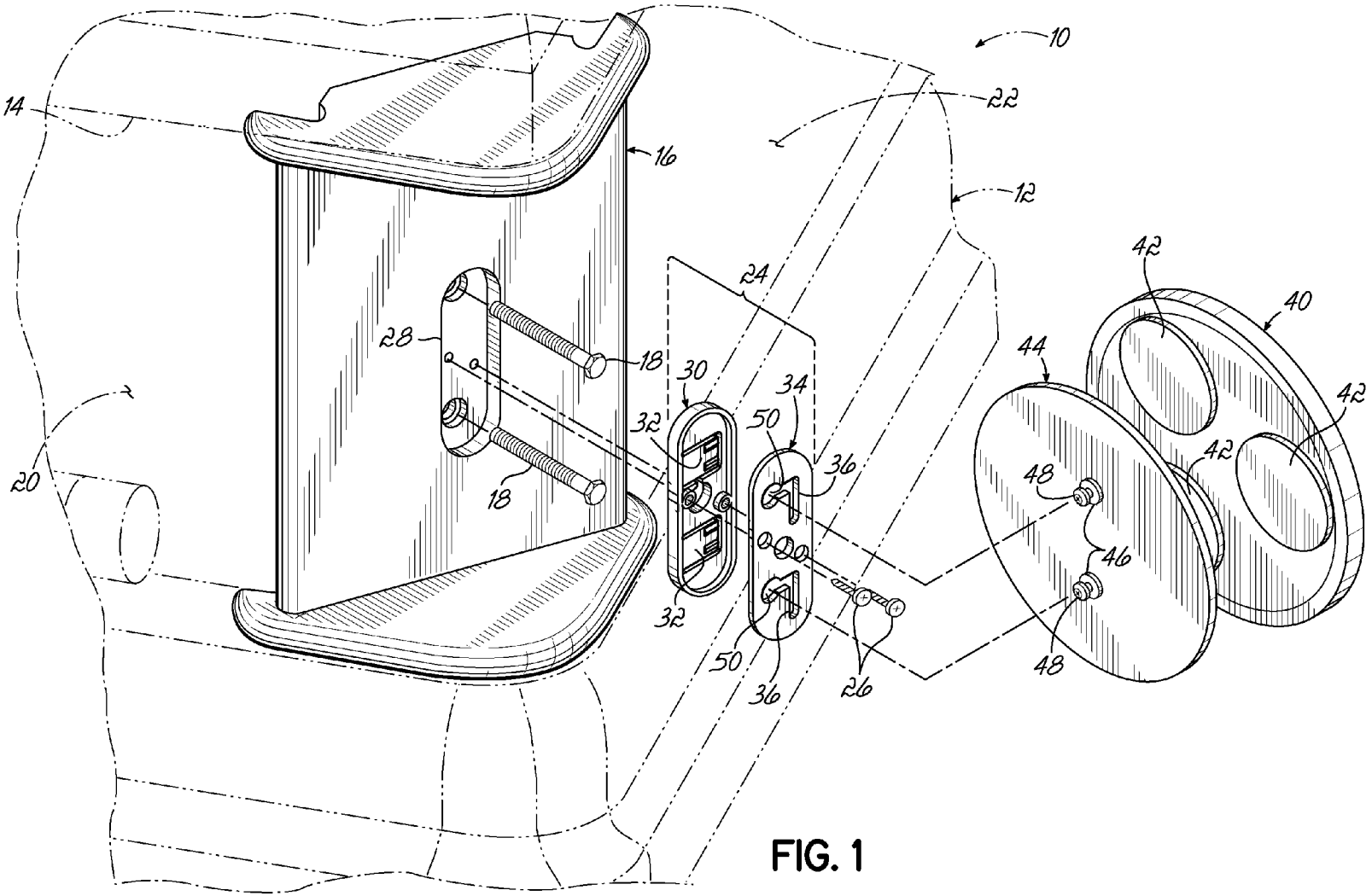
FIG. 1 is a disassembled perspective view of the ornament attachment mechanism used in connection with a casket.

Referring to FIG. 1, a casket 10 comprises a casket shell 12 and a casket lid 14 closable on the shell 12. The shell 12 includes a corner back plate 16 mounted with screws 18 generally at a 45 degree angle relative to the side walls 20 and end walls 22 of the shell 12. A mounting plate 24 is mounted with screws 26 in a recess 28 in the back plate 16. Mounting plate 24 can be, but need not be, of two-piece construction, with a back portion 30 including a pair of vertically spaced spring clips 32, and a front portion 34 including a pair of vertically spaced, and preferably but not necessarily L-shaped, keyhole slots 36. Back portion 30 and front portion 34 may be metallic or plastic or other suitable material. Mounting plate 24 and/or back plate 16 provide one example of a mounting surface for mounting a funerary ornament according to the principles of the present invention.

A medallion casket ornament 40 includes at least one, and preferably three, magnets 42 mounted on a rear side of the ornament 40. A magnetic adapter plate 44 has a pair of vertically spaced fasteners 46 mounted on a rear side of the adapter plate 44, for example welded thereto. Each fastener 46 includes a head 48 thereon. Magnetic adapter plate 44 can be fabricated of a ferrous metal or other magnetic metal or material which is attracted by a magnet, or magnetic adapter plate 44 can itself be a magnet. Accordingly, the term "magnetic adapter plate" shall be construed to embrace all such meanings.

Due to the design of the medallion ornament 40, the surface area of the adapter plate 44 will typically be larger than the surface area of the mounting plate 24. One particularly desirable geometry for the medallion 40 is generally circular and generally disk-shaped, in which case the adapter plate 44 can also be generally circular and generally disk-shaped. The adapter plate 44 will generally be of a smaller diameter than the medallion 40 so as not to show.

To mount the medallion 40 to the casket shell corner, the heads 48 of the fasteners 46 on the adapter plate 44 are inserted through the round holes 50 in the keyhole slots 36. The adapter plate 44 is then moved to the right, and then moved down, to fully seat the fasteners 46 in the slots 36. Then, the medallion 40 may simply be placed on the adapter plate 44, the magnets 42 securing the medallion to the adapter plate 44. In the event that it is desired to attach a traditional corner ornament to the casket shell 12, the medallion 40 may readily be removed from the adapter plate 44, and the adapter plate 44 may readily be removed from the mounting plate 24, at which time the traditional corner ornament with fasteners attached thereto may be removably secured to the mounting plate 24.

Figure 2:
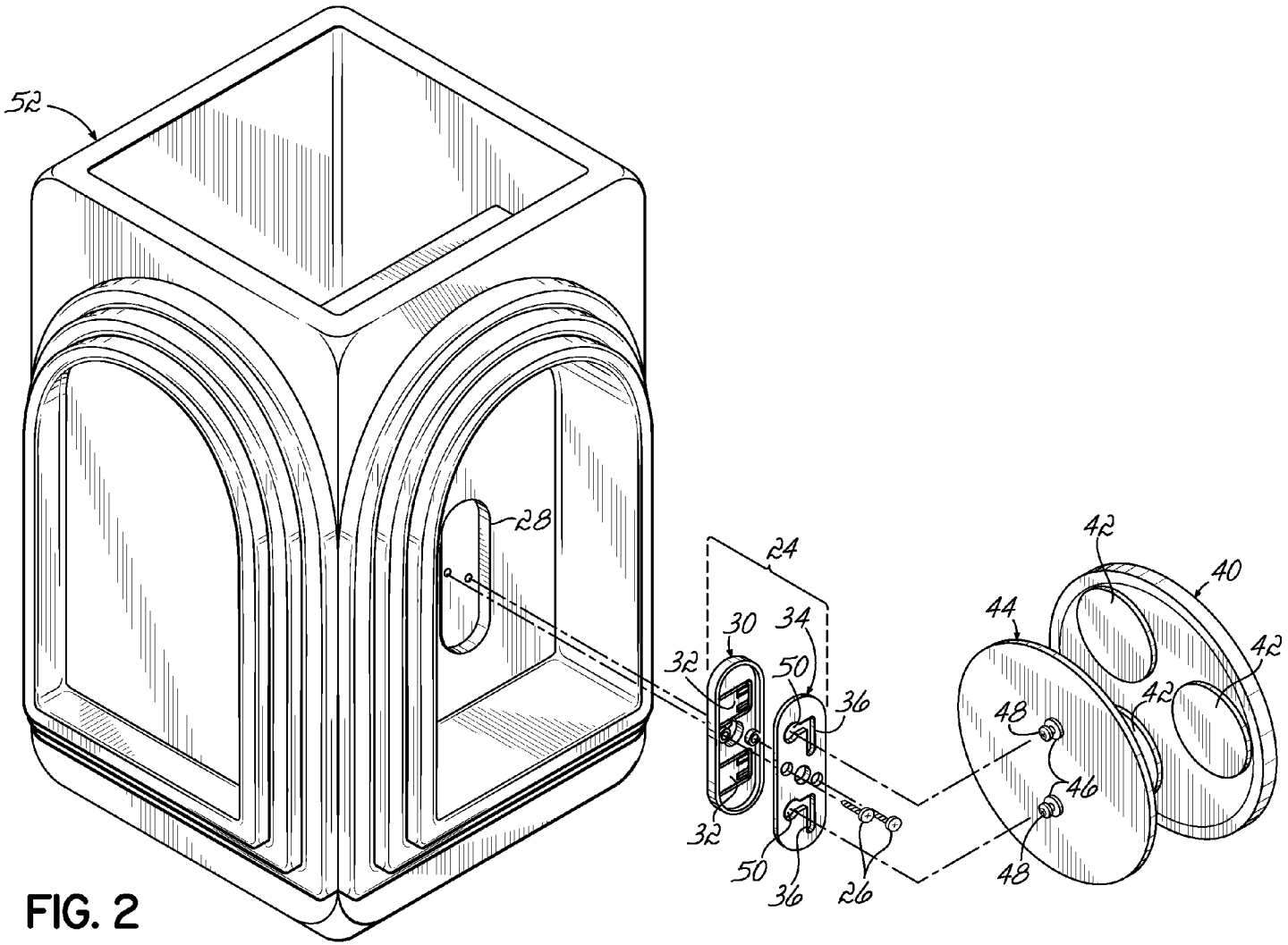
FIG. 2 is a disassembled perspective view of the ornament attachment mechanism of FIG. 1 used in connection with a cremation urn.

Referring to FIG. 2, and with like numbers designating like components, it will be appreciated that the ornament attachment mechanism of this invention can be used in conjunction with urns 52 that are equipped with keyhole ornament attachment plates or surfaces.

Figure 3:
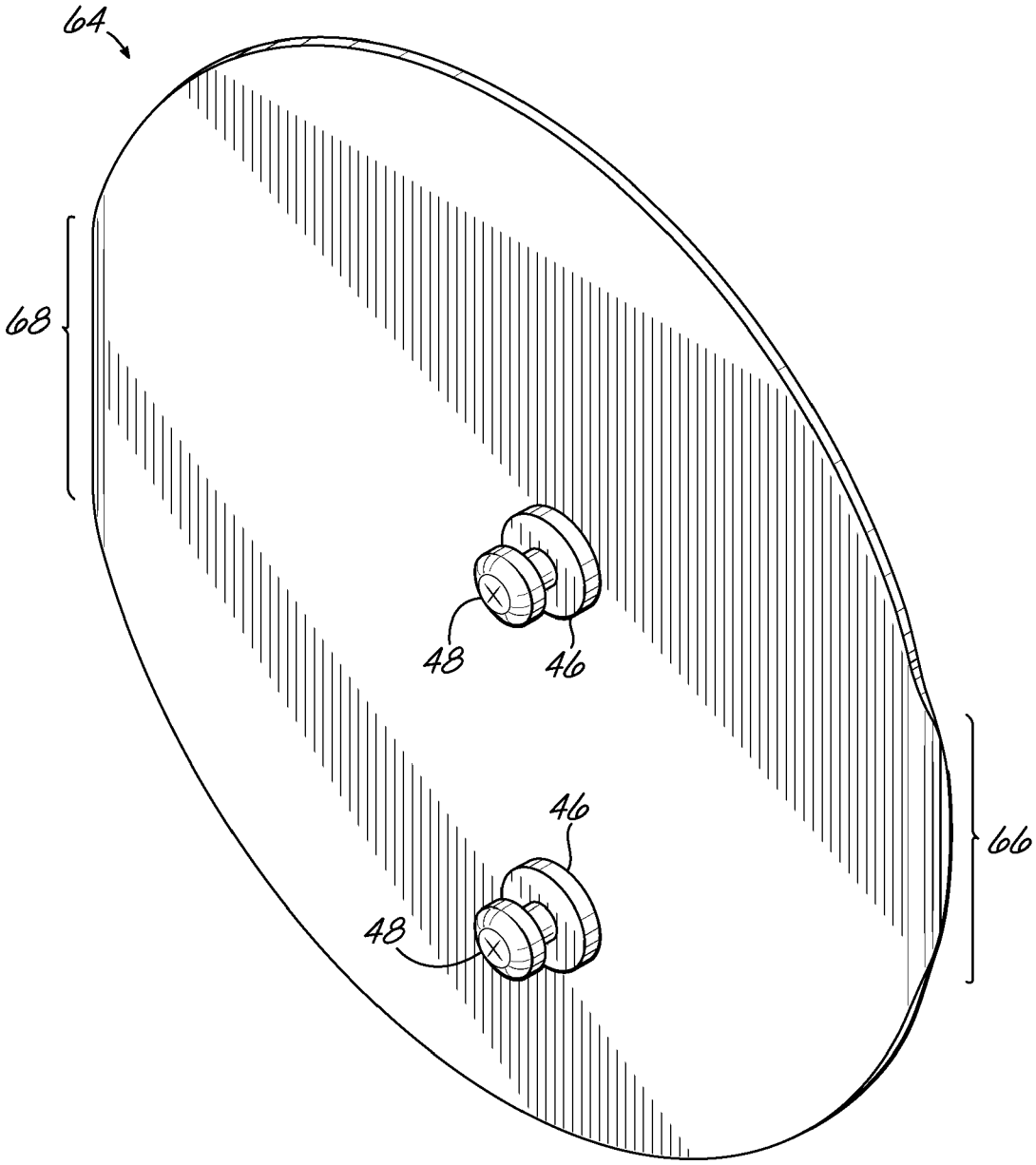
FIG. 3 is another embodiment of the adapter plate.
Figure 4:
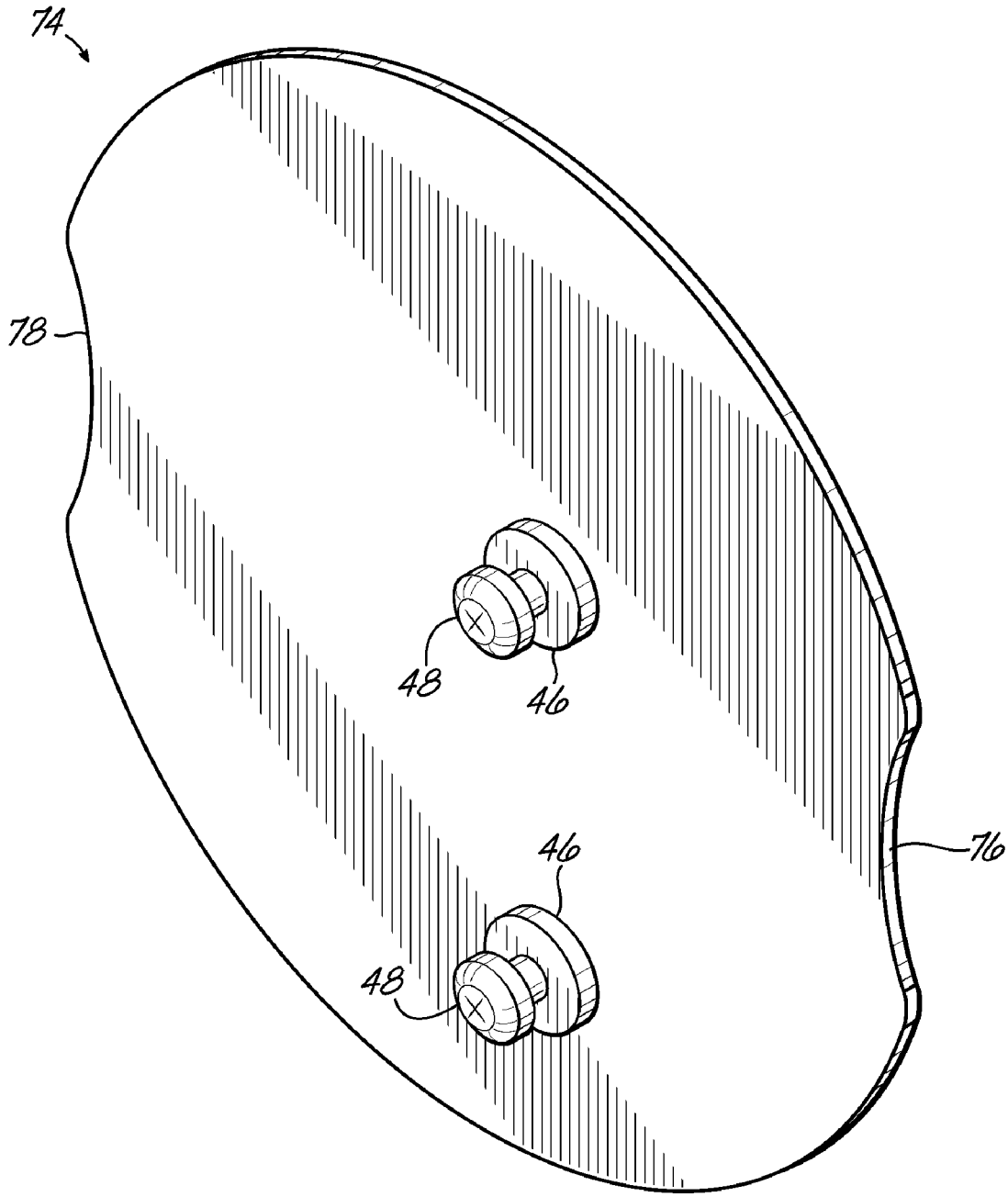
FIG. 4 is yet another embodiment of the adapter plate.
Figure 5:
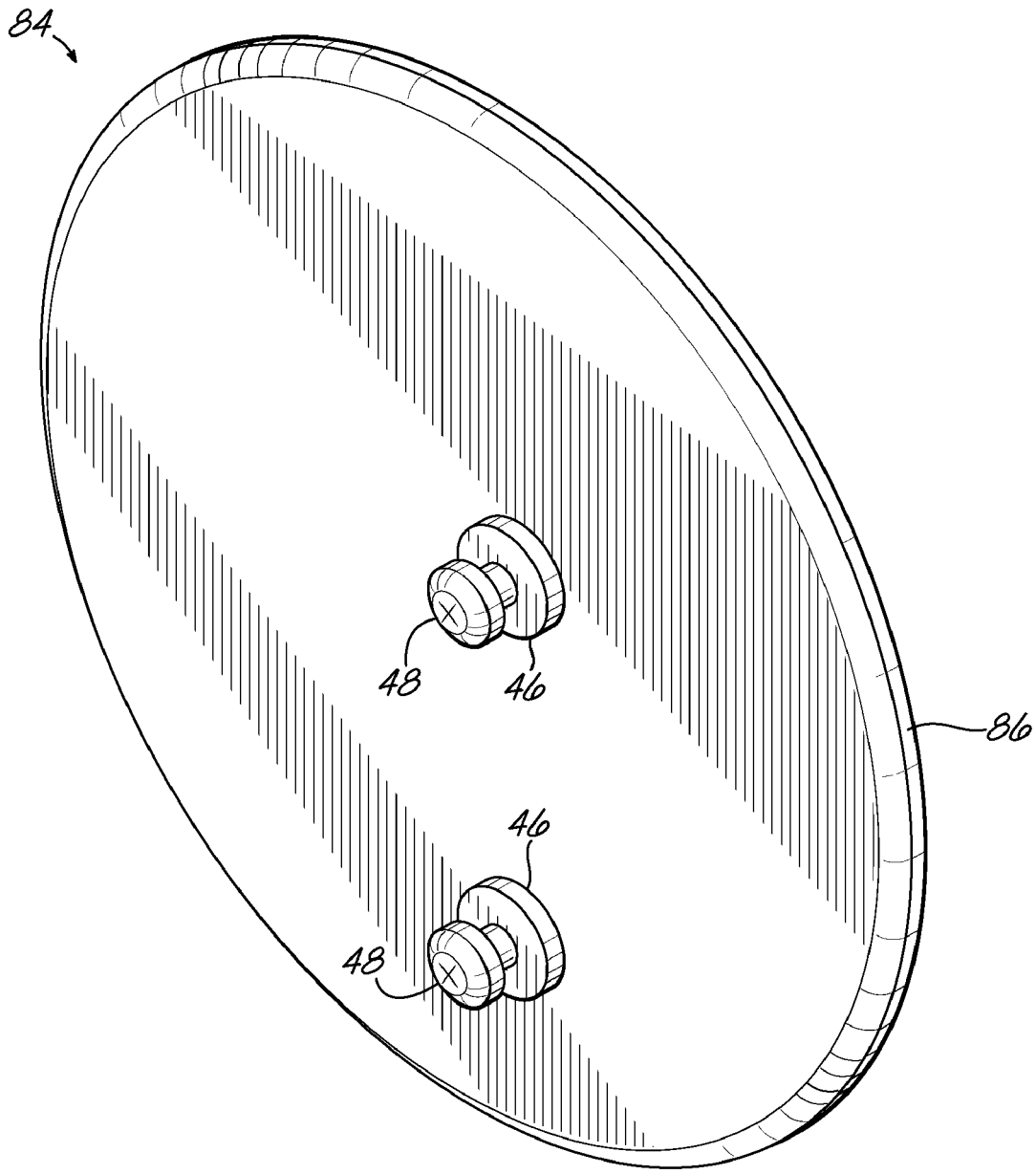
FIG. 5 is still another embodiment of the adapter plate.

Referring not to FIGS. 3-5, various additional embodiments of the adaptor plate 44 are shown. Common to all alternative embodiments is that the adapter plate includes a feature around at least a portion of a periphery thereof that facilitates grasping the periphery of the adapter plate. For example, in the embodiment of FIG. 3, the adapter plate 64 is circular and includes edge portions 66, 68 at 3 o'clock and at 9 o'clock bent forwardly out of a plane defined by a front surface of the adapter plate 64. In the embodiment of FIG. 4, the adapter plate 74 is circular and includes edge scallops 76, 78 at 3 o'clock and at 9 o'clock. In the embodiment of FIG. 5, the adapter plate 84 is circular and includes a forwardly projecting flange 86 around a circumference thereof.

The invention herein can be utilized not only with casket shell corners and urns, but with other funerary articles that employ keyhole groove and fastener with head attachment of ornaments, as well. For example, the invention can be utilized with the casket cap dish assemblies of U.S. Pat. Nos. 7,657,981, 7,584,529, 7,159,287, and 6,715,190, all of which are hereby incorporated by reference herein as if fully set forth in their entirety. The invention can also be utilized with the display plaque of U.S. Pat. No. 6,557,222, and with the display pedestal of U.S. Pat. No. 6,691,385, both of which are hereby incorporated by reference herein as if fully set forth in their entirety.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A casket comprising:

a casket shell, a casket lid closeable on said shell, a mounting plate mounted to said shell, said mounting plate including at least one keyhole groove therein, a medallion casket ornament having a rear side, said ornament including at least one magnet mounted on said rear side, and a magnetic adapter plate having a rear side, said adapter plate including at least one fastener with a head thereon mounted on said rear side, said adapter plate removably secured to said shell by inserting said head of said fastener in said keyhole groove in said mounting plate and seating said head of said fastener in said keyhole groove, said casket ornament removably magnetically secured to said shell by positioning said at least one magnet of said ornament on said adapter plate.

2. The casket of claim 1 wherein said mounting plate includes two vertically spaced said keyhole grooves therein, each being L-shaped, and wherein said adapter plate includes two vertically spaced said fasteners.

3. The casket of claim 1 wherein a surface area of said adapter plate is larger than a surface area of said mounting plate.

4. The casket of claim 1 wherein said adapter plate and medallion casket ornament are generally circular.

5. The casket of claim 4 wherein said adapter plate and said medallion casket ornament are generally disk-shaped.

6. The casket of claim 1 wherein said adapter plate includes a feature around at least a portion of a periphery thereof that facilitates grasping the periphery of said adapter plate.

7. The casket of claim 6 wherein said adapter plate is circular and said feature includes edge portions at 3 o'clock and at 9 o'clock bent forwardly out of a plane defined by a front surface of said adapter plate.

8. The casket of claim 6 wherein said adapter plate is circular and said feature includes edge scallops at 3 o'clock and at 9 o'clock.

9. The casket of claim 6 wherein said adapter plate is circular and said feature includes a forwardly projecting flange around a circumference thereof.

10. A funerary receptacle for containing remains of a deceased, said receptacle comprising:

a container adapted to contain the remains, a lid closeable on said container, a mounting plate mounted to said container, said mounting plate including at least one keyhole groove therein, a medallion funerary receptacle ornament having a rear side, said ornament including at least one magnet mounted on said rear side, and a magnetic adapter plate having a rear side, said adapter plate including at least one fastener with a head thereon mounted on said rear side, said adapter plate removably secured to said container by inserting said head of said fastener in said keyhole groove in said mounting plate and seating said head of said fastener in said keyhole groove, said ornament removably magnetically secured to said container by positioning said at least one magnet of said ornament on said adapter plate.

11. The funerary receptacle of claim 10 wherein said container is a casket shell.

12. The funerary receptacle of claim 10 wherein said container is a cremation urn.

13. The funerary receptacle of claim 10 wherein said mounting plate includes two vertically spaced said keyhole grooves therein, each being L-shaped, and wherein said adapter plate includes two vertically spaced said fasteners.

14. The funerary receptacle of claim 10 wherein a surface area of said adapter plate is larger than a surface area of said mounting plate.

15. The funerary receptacle of claim 10 wherein said adapter plate and medallion ornament are generally circular.

16. The funerary receptacle of claim 10 wherein said adapter plate and said medallion ornament are generally disk-shaped.

17. The funerary receptacle of claim 10 wherein said adapter plate includes a feature around at least a portion of a periphery thereof that facilitates grasping the periphery of said adapter plate.

18. The funerary receptacle of claim 17 wherein said adapter plate is circular and said feature includes edge portions at 3 o'clock and at 9 o'clock bent forwardly out of a plane defined by a front surface of said adapter plate.

19. The funerary receptacle of claim 17 wherein said adapter plate is circular and said feature includes edge scallops at 3 o'clock and at 9 o'clock.

20. The funerary receptacle of claim 17 wherein said adapter plate is circular and said feature includes a forwardly projecting flange around a circumference thereof.

21. A funerary article comprising:

a mounting surface including at least one keyhole groove therein, a medallion funerary ornament having a rear side, said ornament including at least one magnet mounted on said rear side, and a magnetic adapter plate having a rear side, said adapter plate including at least one fastener with a head thereon mounted on said rear side, said adapter plate removably secured to said mounting surface by inserting said head of said fastener in said keyhole groove in said mounting surface and seating said head of said fastener in said keyhole groove, said ornament removably magnetically secured to said adapter plate by positioning said at least one magnet of said ornament on said adapter plate.

* * * * *